US007571942B2

(12) United States Patent
Shapiro et al.

(10) Patent No.: US 7,571,942 B2
(45) Date of Patent: Aug. 11, 2009

(54) UNIVERSAL FLOOR AND BUCKET PROTECTION DEVICES, SYSTEMS, AND METHODS

(76) Inventors: Edward Shapiro, 108 Cocksfield Avenue, Toronto, Ontario (CA) M3H 3T2; Craig Kack, 38 Bower Street, Acton, Town of Halton Hills, Ontario (CA) L7J 1E2

( * ) Notice: Subject to any disclaimer, the term of this patent is extended or adjusted under 35 U.S.C. 154(b) by 348 days.

(21) Appl. No.: 11/322,466

(22) Filed: Dec. 30, 2005

(65) Prior Publication Data

US 2006/0145489 A1 Jul. 6, 2006

Related U.S. Application Data

(60) Provisional application No. 60/641,056, filed on Jan. 3, 2005.

(51) Int. Cl.
*B61F 19/06* (2006.01)

(52) U.S. Cl. ..... 293/38

(58) Field of Classification Search ..... 293/38, 293/104, 112, 120, 121, 155
See application file for complete search history.

(56) References Cited

U.S. PATENT DOCUMENTS 3,726,544 A * 4/1973 Miller ..... 280/851
3,778,086 A * 12/1973 Moore et al. ..... 280/851
3,788,668 A * 1/1974 Perger ..... 280/851
3,799,580 A * 3/1974 McGuire ..... 280/851
4,951,994 A * 8/1990 Miwa ..... 296/180.1
5,462,324 A * 10/1995 Bowen et al. ..... 293/15
5,735,560 A * 4/1998 Bowen et al. ..... 293/15
6,079,769 A * 6/2000 Fannin et al. ..... 296/180.1
6,089,628 A * 7/2000 Schuster ..... 293/118
6,279,974 B1 * 8/2001 McCormack ..... 293/128
6,416,094 B1 * 7/2002 Cherry ..... 293/120
6,460,909 B2 * 10/2002 Mansoor et al. ..... 293/120
6,874,842 B2 * 4/2005 Hojna ..... 296/180.1

OTHER PUBLICATIONS

Schuyler Rubber Co., Woodinville, WA, Product Information Sheet for Rubber Cutting Edge, Large Wheel Loaders, Pushing Operations, Model 911B [online], Retrieved from the Internet: http://www.schuylerrubber.com/cuttingedge/modelB.pdf, Nov. 4, 2005.
Schuyler Rubber Co., Woodinville, WA, Product Information Sheet for Rubber Cutting Edge, Large Wheel Loaders, Pushing/Scooping Operations, Model 911R [online], Retrieved from the Internet: http://www.schuylerrubber.com/cuttingedge/modelR.pdf, Nov. 4, 2005.

(Continued)

*Primary Examiner*—H Gutman
(74) *Attorney, Agent, or Firm*—Woodard, Emhardt, Moriarty, McNett & Henry LLP

(57) ABSTRACT

For a floor clearing bucket, blade or other component of a machine, a guard including a rigid attachment device and elastomeric wear pad assembly has a bolt or stud fastener mounted sideways to facilitate spacing fasteners to match pre-existing, guard-mounting holes in the component for attaching the guard to the component.

29 Claims, 14 Drawing Sheets

OTHER PUBLICATIONS

Schuyler Rubber Co., Woodinville, WA, Product Information Sheet for Rubber Cutting Edge, Skidsteers and Small Loaders/Backhoes, Model 911S [online], Retrieved from the Internet: http://www.schuylerrubber.com/cuttingedge/modelS.pdf, Nov. 4, 2005.

Schuyler Rubber Co., Woodinville, WA, Product Information Sheet for Rubber Cutting Edge, Mid-size Wheel Loaders/Backhoes, Scooping Operations, Model 911T [online], Retrieved from the Internet: http://www.schuylerrubber.com/cuttingedge/modelT.pdf, Nov. 4, 2005.

Schuyler Rubber Co., Woodinville, WA, Product Information Sheet for Schuyler Rubber Bucket Scraper with Easy Slide T-Track Adjustable Channel, Design Specifications, Retrieved from the Internet: http://www.schuylerrubber.com/scrapers.html, Jun. 18, 2003.

Schuyler Rubber Company: Innovative products from scrap tires, News Link, Fall 2003, 2 pages.

http://mm1.wastenews.com/productarc2.html?pcat=Buckets; 2 pages dated Nov. 11, 2005.

http://news.thomasnet.com/fullstory/25441; 3 pages dated Nov. 11, 2005.

http://www.schuylerrubber.com/scrapers_pics.html, 8 pages dated Nov. 11, 2005.

http://www.schuylerrubber.com/new_press_scraper.html, 3 pages dated Nov. 11, 2005.

* cited by examiner

UNIVERSAL FLOOR AND BUCKET PROTECTION DEVICES, SYSTEMS, AND METHODS

REFERENCE TO RELATED APPLICATIONS

This application claims the benefit of U.S. Provisional Application No. 60/641,056, filed Jan. 3, 2005, which is incorporated by reference herein in its entirety.

BACKGROUND

This invention generally relates to devices for protecting a floor or surface and a bucket or scoop from costly wear and/or damage during material handling operations. More particularly, this invention relates to improvement of protective guard application to material handling equipment.

In material handling operations, heavy equipment and other vehicles equipped with plows, buckets, or scoops (components) are used to push, pull, or pick up various types of material, debris, and/or liquids. When undertaking these material-handling operations, the component routinely contacts the surface on which the material, debris and/or liquid resides. This routine contact causes damage to both the surface, which typically is concrete, and the component, which typically is made from carbon steel. The damage caused to the concrete and component is expensive to repair.

In order to mitigate the damage imparted to the concrete or other type of surface, and the component, others have attached wear guards to the component at the place where the component contacts the surface. These wear guards have been made from various materials, such as metal, used tire carcasses, and solid rubber. These wear guards are typically attached to the component using bolts mounted at fixed locations on the wear guard. In order to install these typical wear guards, the component owner must obtain a wear guard having a bolt pattern precisely matching the component's preexisting bolt hole pattern, or drill holes in the component which correspond to the bolt pattern of a wear guard.

Yet another problem is that some wear guards are positioned on some vehicles such that the front of the wear guard is subject to impact damage. Usage of such wear guards results in frontal damage that pulls the wear guard out of contact with the floor, weakens the bond between the contacting portion of the guard and the more rigid supporting portion, or other problems. This damage to the front lip and the possible loss of adhesion of the elastomeric element results in improper scraping and the need to prematurely replace the wear guard.

Some embodiments of the present invention address these and other problems in novel and unobvious ways.

SUMMARY OF THE INVENTION

According to one aspect of the present invention, there is an apparatus for protecting the bottom of a bucket scraper. Another aspect concerns a resilient member having a first length substantially greater than its width, the resilient member having a top surface which is at least partially concave. Yet another aspect concerns a rigid member having a second length about the same as the first length, the rigid member having a bottom surface which is at least partially convex in a shape that is complementary to the concave shape of the top surface of the resilient member, the rigid member having a top surface which defines a slot across substantially the entire second length.

Another aspect concerns the rigid member has opposing ends separated by the second length, the slot being open at one of the ends wherein the resilient member comprises an elastomeric material that is bonded to the rigid member. Yet another aspect of the current invention the rigid member is an extrusion.

According to yet another aspect of some embodiments of the present invention, there is an apparatus for protecting a bottom surface of a front loader. Another embodiment comprises an elastomeric member having a first length substantially greater than its width. Yet another embodiment of the present invention includes a supporting member having a front, a rear, a top surface, a bottom surface, and a second length about the same as the first length, the bottom surface having a shape that is generally complementary to the shape of the top surface of the elastomeric member, the top surface defining a slot oriented along the length of the supporting member, the distance from the top surface of the supporting member to the bottom surface of the supporting member being nonconstant from front to rear. According to another embodiment of the present invention, the bottom of the supporting member is attached to the top of the elastomeric member.

These and other aspects of various embodiments of the present invention will be apparent from the text, drawings, and claims to follow.

DESCRIPTION OF THE ILLUSTRATED EMBODIMENTS

For the purpose of promoting an understanding of the principles of the invention, reference will now be made to the illustrated embodiments and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Figure 1:
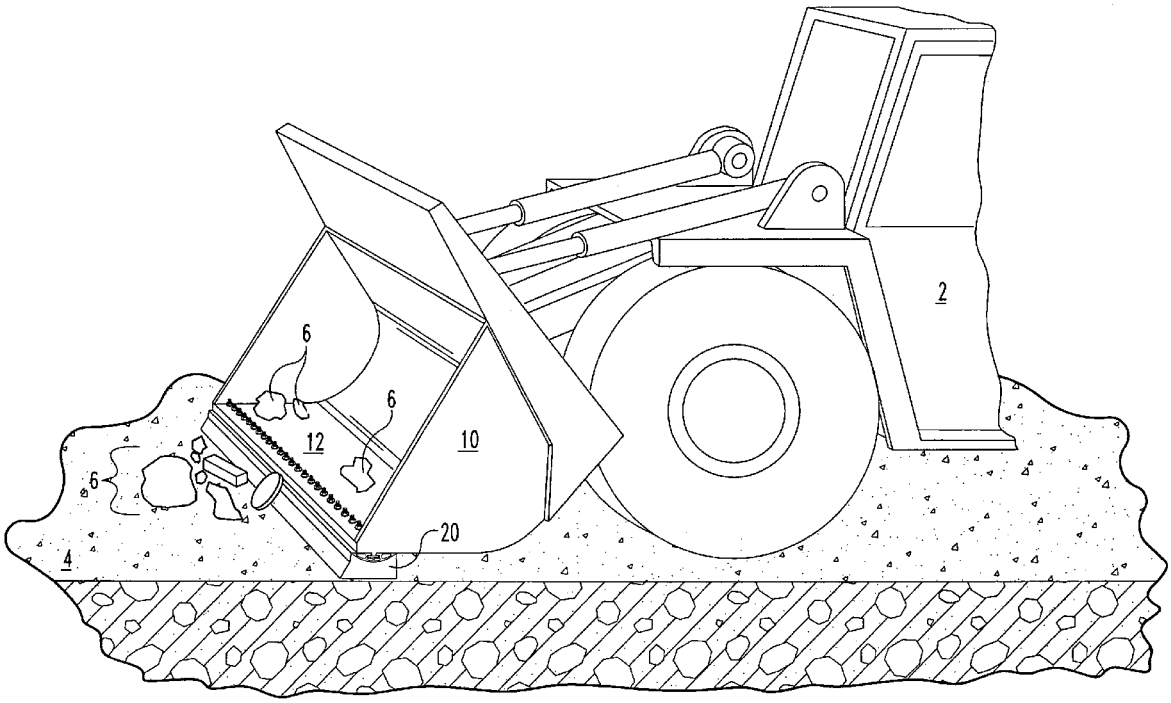
FIG. 1 is a pictorial view of a frontal portion of a front-end loader machine with a guard assembly on the machine bucket according to one embodiment of the present invention.
Figure 2:
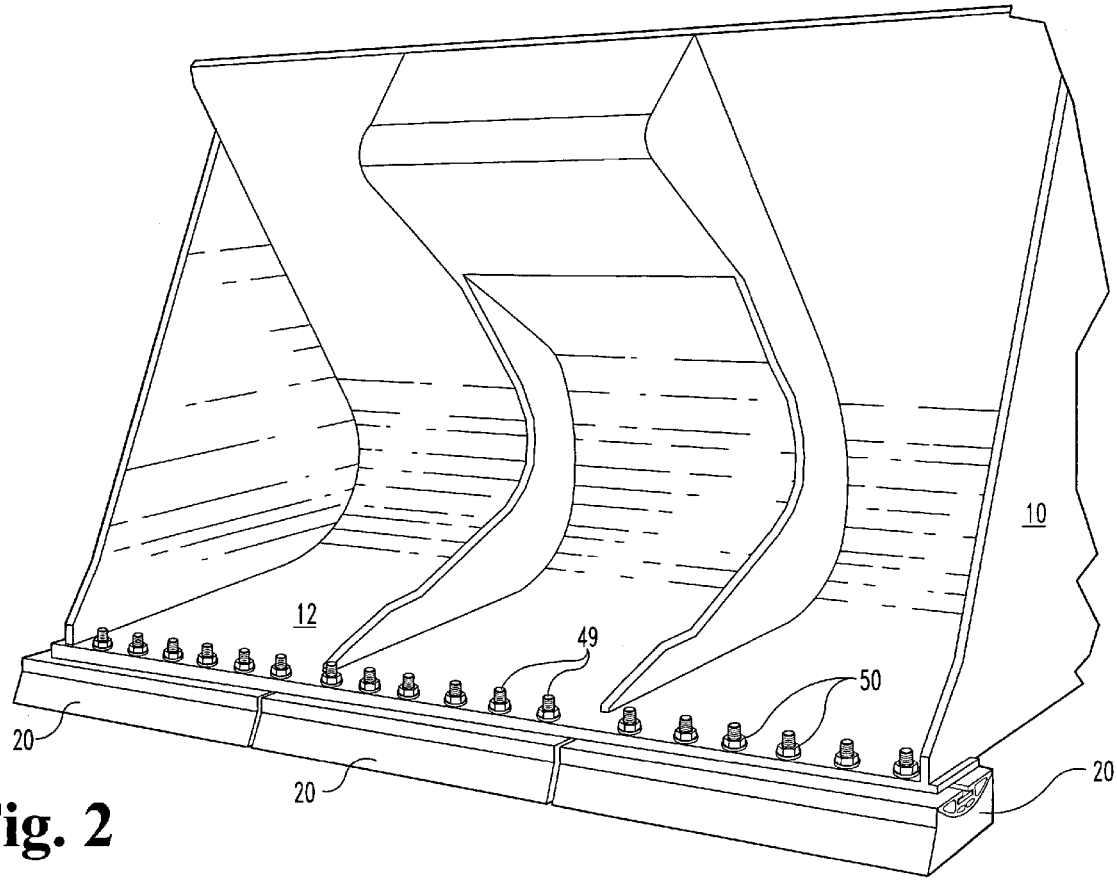
FIG. 2 is a pictorial view of a front-end loader bucket guard assembly according to one embodiment of the present invention provided in modules according to one embodiment of the present invention.

FIGS. 1 and 2 show a guard 20 according to one embodiment of the invention for protecting the bottom surface of a component such as a bucket 10 and the surface 4 otherwise contacted by the bucket. In one embodiment, guard 20 is also referred to as a rubber cutting edge. The guard 20 is mounted to the bottom 12 of the bucket 10, which is mounted on a front-end loader 2. Such front-end loaders usually have hydraulic controls for manipulating the bucket. The guard is fastened to the bottom of the bucket by a set of fasteners 49 through holes in the bucket bottom. The front-end loader 2 is used to move the bucket, with attached guard 20, along the surface 4 in order to push and/or pick up material 6. In pushing, the front-end loader operator normally maintains guard 20 in contact with the surface 4. As seen in FIG. 2, bucket 10 has mounted to the bottom surface of it three separate guards 20 of equal length. However, the present invention also contemplates those embodiments in which a single guard extends across the bottom surface of the component being protected, as seen in FIG. 1.

It is understood that the invention is not limited to use on a front-end loader. Rather, an inventive guard can be affixed to a wide variety of vehicles, including, for example but without limitation, a tractor, a truck, a bulldozer, a grader, a fork truck, a car, a conveyor, or any other material handling equipment for which a wear pad is desired. Furthermore, a wide variety of components are contemplated by the invention to which an inventive wear guard can be attached, including, for example and without limitation, buckets, scoops, blades, forks, plows, or other such devices.

FIGS. 3-6 depict a wear guard assembly in accordance with one embodiment of the present invention. In this embodiment, guard 20 comprises a preferably rigid elongate attachment portion 24 bonded to a wear resilient, preferably elastomeric pad 22. The elongate attachment portion holds and/or guides one or more fastener assemblies 40 for attachment to a surface engaging portion of the component. In the embodiment shown, elongate attachment portion 24 comprises a plate with a longitudinal track 26 that holds and/or guides one or more movable fastener assemblies 40. The longitudinal track 26 includes a longitudinal cavity or channel 28 with a first cross-sectional width 32 located beneath a longitudinal slot 30 having a second cross-sectional width 34. The first cross-sectional width 32 is greater than the second cross-sectional width 34. The longitudinal track 26 is preferably continuous and preferably extends the entire length of the wear pad 22.

In addition, in the wear guard 20 depicted in FIGS. 3-6, the elongate attachment portion 24 extends almost the full width of the wear pad 22. It is understood, however, that the width of the elongate attachment portion 24 can be less than or greater than the wear pad 22 width. Preferably there is sufficient contact area between the bottom surface 29 of attachment portion 24 and the top surface 21 of wear pad 22 to fully secure the wear pad 22 to the elongate attachment portion 24. In the embodiment depicted in FIG. 1, the elongate attachment portion 24 is bonded to the upper surface of the wear pad 22 using a bonding agent. It is understood, however, that the invention is not limited to this configuration, and that other possible embodiments are included within the scope of this invention. For example, in other embodiments, the elongate attachment portion 24 is embedded in a slot or channel formed in the wear pad 22. When such an embodiment is used, the elongate attachment portion is preferably also bonded to the wear pad using a bonding agent to prevent separation of the attachment portion from the wear pad under the shear forces exerted upon the wear guard in use.

In the embodiment depicted in FIGS. 3-16, the longitudinal track 26 is shown as being generally centered in relation to the top width of the wear pad 22, with a front edge or nose 23 extending forward at a shallower angle than the upper portion of wear pad 22. This configuration is not critical, and non-centered tracks 26 are also contemplated within various embodiments of the present invention. However, centering allows the wear guard 20 to be rotated from front to back in the event of unproportional wear of the wear pad. In some alternative embodiments of the invention, the longitudinal track 26 in the wear pad 22 is placed at a non-centered location. In addition, the width of the wear pad 22 or wear guard 20 is not essential to the present invention. Nevertheless, in one embodiment, the wear guard 20 is wide enough such that, upon affixing the wear guard to a bucket 10 or other component, it extends beyond the front edge of the bucket 10 or other component. In one preferred embodiment, the wear guard 20 extends up to about 2 inches beyond the front edge of the bucket 10. In another embodiment, the wear guard 20 extends approximately one inch beyond the front edge of the bucket 10.

Figure 3:
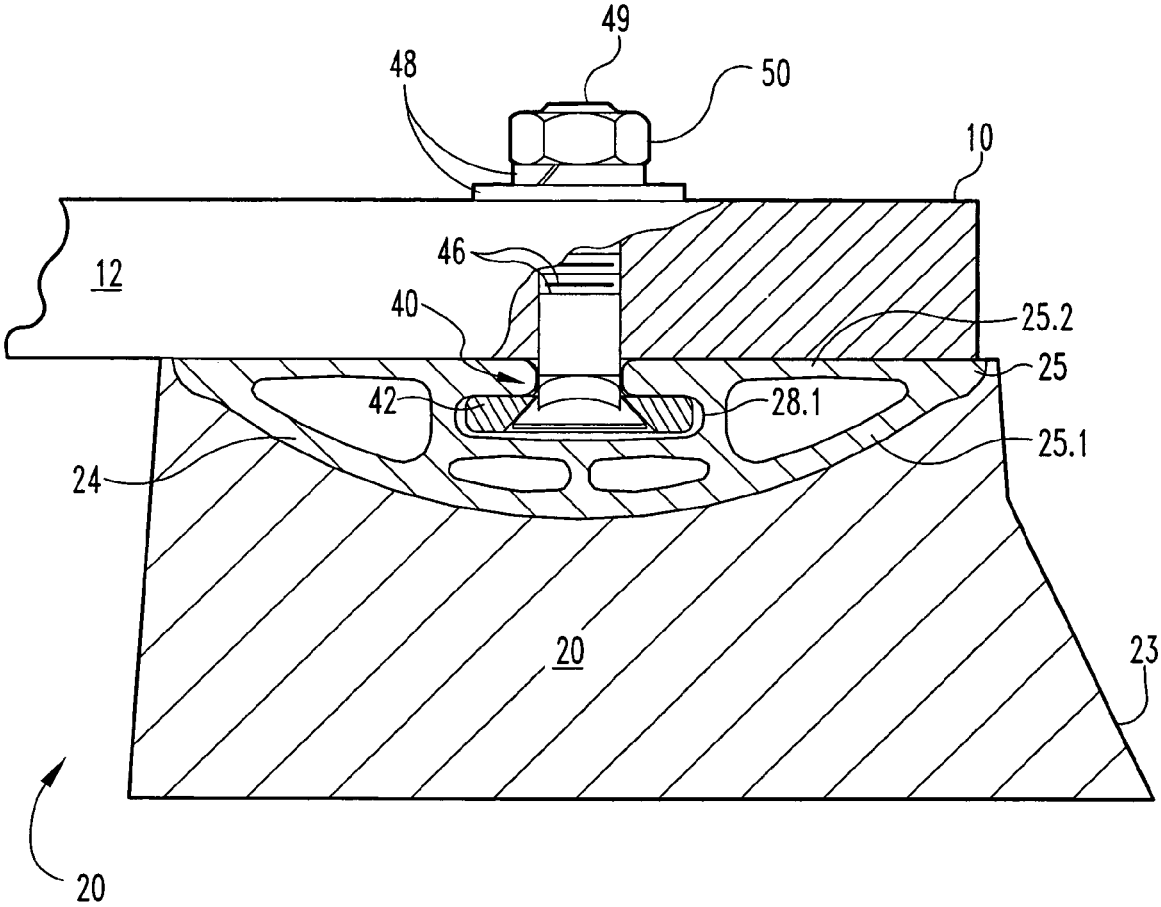
FIG. 3 is an end view of a guard according to one embodiment of the present invention attached to a bucket bottom shown fragmentarily.

In those embodiments in which the wear guard 20 extends beyond the front edge of bucket 10 (as best seen in FIG. 3) there could be impact loads imparted to the front edge or nose 25 of rigid member 24. Some embodiments of the present invention include a front edge or nose 25 that is adapted and configured to withstand typical impacts without permanent deformation. Embodiments with such adaptations are shown in FIGS. 3, 10, 11, and 12. Referring to FIG. 3, rigid member 24 includes a front nose 25 which is at the vertex of a substantially horizontal reinforcing portion 25.2 and an angled reinforcing portion 25.1. For longitudinal loads impacting the nose 25, the loads will be distributed both horizontally (via 25.2 and in part via 25.1) and vertically (in part via 25.1). It is appreciated that the front portion of rigid member 24 (from nose 25 to the front edge 28.1 of longitudinal cavity 28) has an increasing area moment of inertia (also referred to as a second moment of area or a cross-sectional moment of inertia) in a direction from front to rear. Thus, any impact load on nose 25 is distributed into a front structure of rigid member 24 that increases in stiffness and strength, making it less likely that any impact will leave any substantial permanent deformation.

Figure 10:
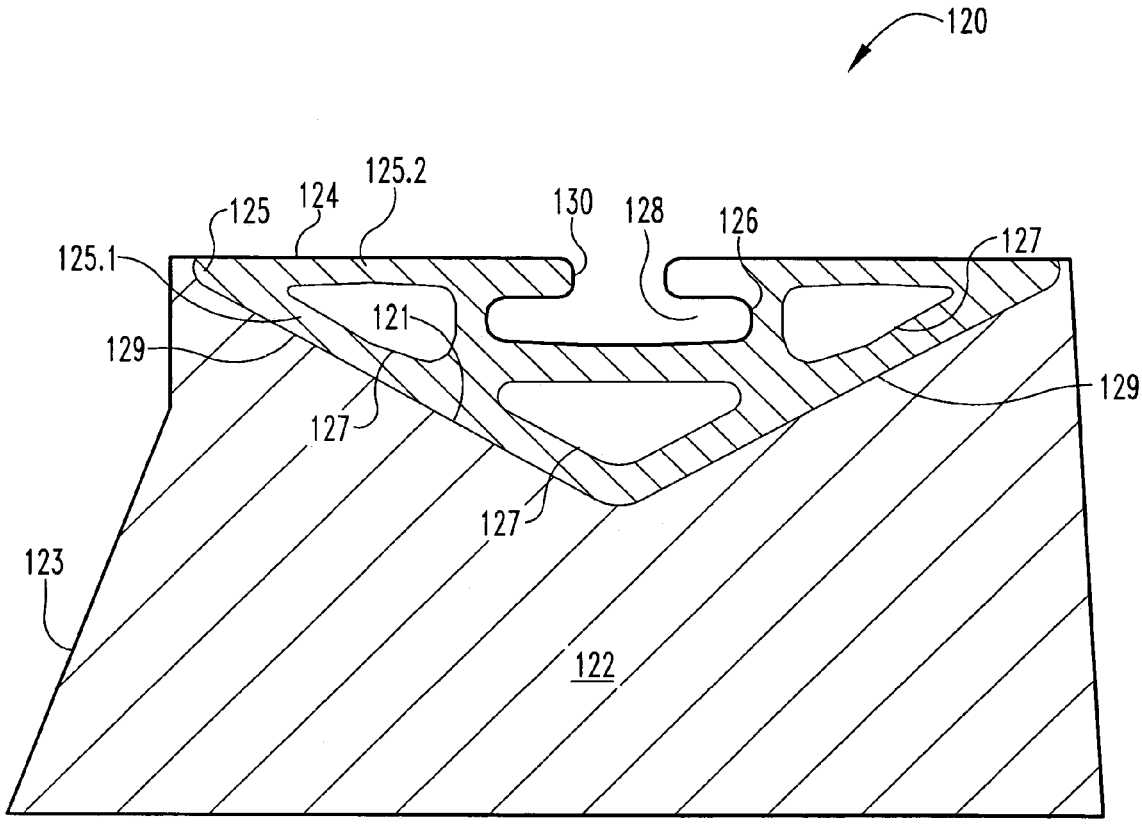
FIG. 10 is an end view of a guard assembly according to one embodiment of the present invention.
Figure 11:
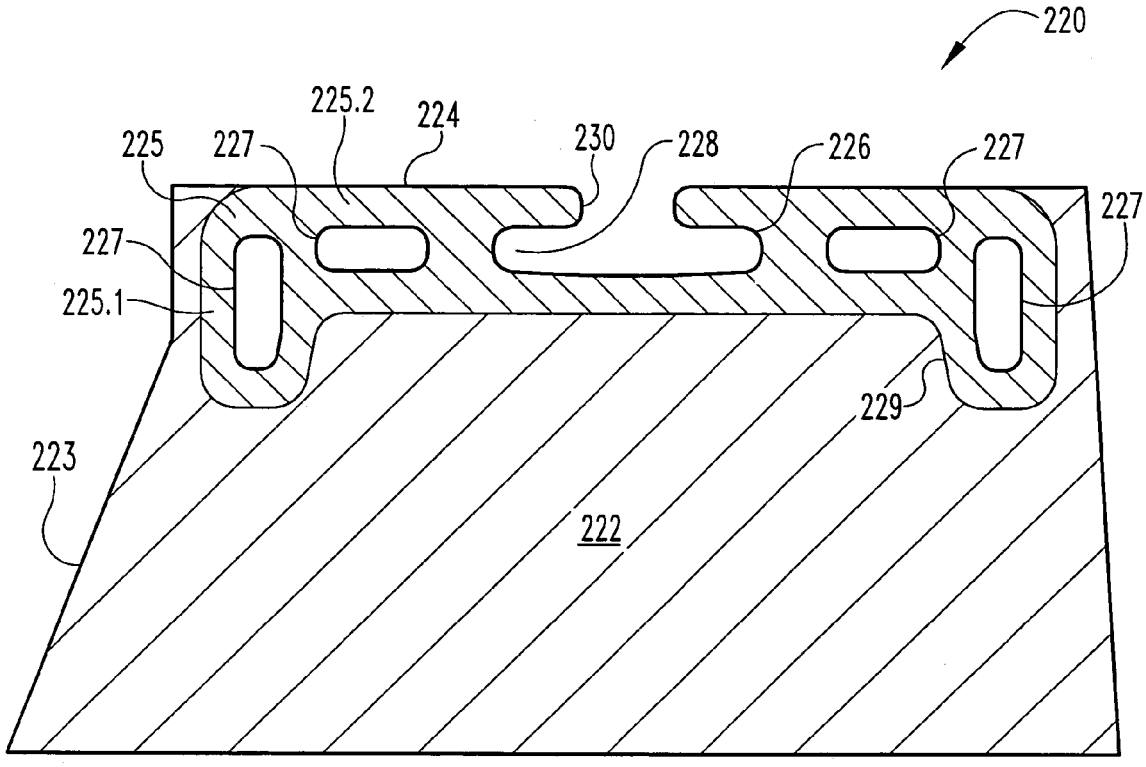
FIG. 11 is an end view of a guard assembly according to one embodiment of the present invention.

Referring now to FIG. 10, it can be seen that rigid member 124 likewise includes a nose portion 125 which is a vertex of a substantially horizontal portion 125.2 and a reinforcing portion 125.1 which moves away with a vertical component from portion 125.2. Referring to FIGS. 3 and 10, it can be seen that the area moment of inertia for rigid members 24 and 124 increases going from nose 25 or 125, respectively, to the center of slot 30 or 130, respectively. This is in contrast to other, non-inventive cross sectional shapes in which the bottom surface of the rigid member is substantially parallel to the planar top surface, which thereby have a substantially constant area moment of inertia in the fore and aft direction. Referring now to FIG. 11, there is seen an alternate embodiment of the invention in which a guard assembly 220 includes a rigid member 224 having a reinforced nose 225 that is a vertex at the joining of a horizontal portion 225.2 and a substantially vertical portion 225.1.

The rigid, elongate attachment member 24 can be made of a wide variety of materials using a wide variety of manufacturing processes. It is preferred that the attachment portion be rigid to provide structural integrity and robustness to the wear guard. In one preferred embodiment, elongate attachment portion 24 is made from steel or a suitable steel alloy, such as a carbon steel alloy. In alternative embodiments, the elongate attachment portion 24 can be constructed from a different material, such as, for example and without limitation, aluminum, extruded aluminum, stainless steel, cast iron, TEFLON®, PTFE, ABS, polyurethane, nylon, fiber reinforced plastic, or other similar material or combination of materials.

The wear pad 22 may be made from a wide variety of durable materials. In certain preferred embodiments, wear pad 22 is made using a rubber compound, such as, for example, a natural rubber, a synthetic rubber, a reinforced rubber, or other elastomeric material or other plastic material. As will be readily appreciated by a person of ordinary skill in the art, a typical rubber compound will include rubber polymers, carbon black, oil, curing agents and protective ingredients. A wide variety of such compounds are contemplated by the invention, and are well within the purview of a person of ordinary skill in the art. In one particularly preferred embodiment, the rubber polymer is a natural rubber. In another embodiment, the wear pad 22 is made of polyurethane or other plastic or thermoplastic polymer-based compound. The wear pad can alternatively be a steel reinforced rubber pad as described in U.S. Pat. Nos. 5,471,770, 5,611,157, and 5,741,112, the disclosures of which are hereby incorporated herein by reference. Additional materials that are contemplated for use in the construction of a wear pad in accordance with the invention include, for example and without limitation, TEFLON®, PTFE, ABS, polyurethane, thermoplastic polymer-based compounds, tire carcass or any material or any useful combination thereof.

The wear pad 22 can be made in a variety of different methods, and the preferred manner of making the wear pad will depend upon the material used. For example, in a preferred embodiment, the wear pad is made by laminating a strip of rubber compound from a rubber mill to form a preform to the appropriate width, length and weight. It is, of course, understood that the method for making a laminated strip of rubber may also include cutting steps to cut the strip to an appropriate width, length, and weight. The preform is then cured to the appropriate state and in an appropriate shape. In one preferred manner of curing the preform, it is placed on top of an already prepared elongate attachment portion in a compression mold. The mold is then closed in a press and held under pressure and heat conditions until the desired state of cure of the rubber compound is achieved. Alternatively, the wear pad can be constructed by pouring urethane or other suitable polymer into a suitable mold or form.

It is understood that the wear pad 22 will have a top surface 21 that has a shape configured to receive and bond to the bottom surface 29 of the elongate attachment portion 24. This top surface of the wear pad can be smooth or can have a texture if desired to achieve suitable bonding. The other sides of the wear pad can have a wide variety of surface shapes and features, and such shapes and features are within the scope of this invention. For example, the sides, preferably the leading edge, of the wear pad can include wording or lettering or one or more logos embossed thereon. Furthermore, in the embodiment depicted in FIGS. 2 and 3, the cross-sectional geometric shape of the wear pad 22 is predominately rectangular. However, other embodiments include any suitable cross-sectional geometric shape. For example, other such alternative embodiments include cross-sectional geometric configurations such as those disclosed in U.S. Pat. No. 5,611,157 and U.S. Pat. No. 5,741,112, each of which is incorporated herein by reference in its entirety.

Figure 6:
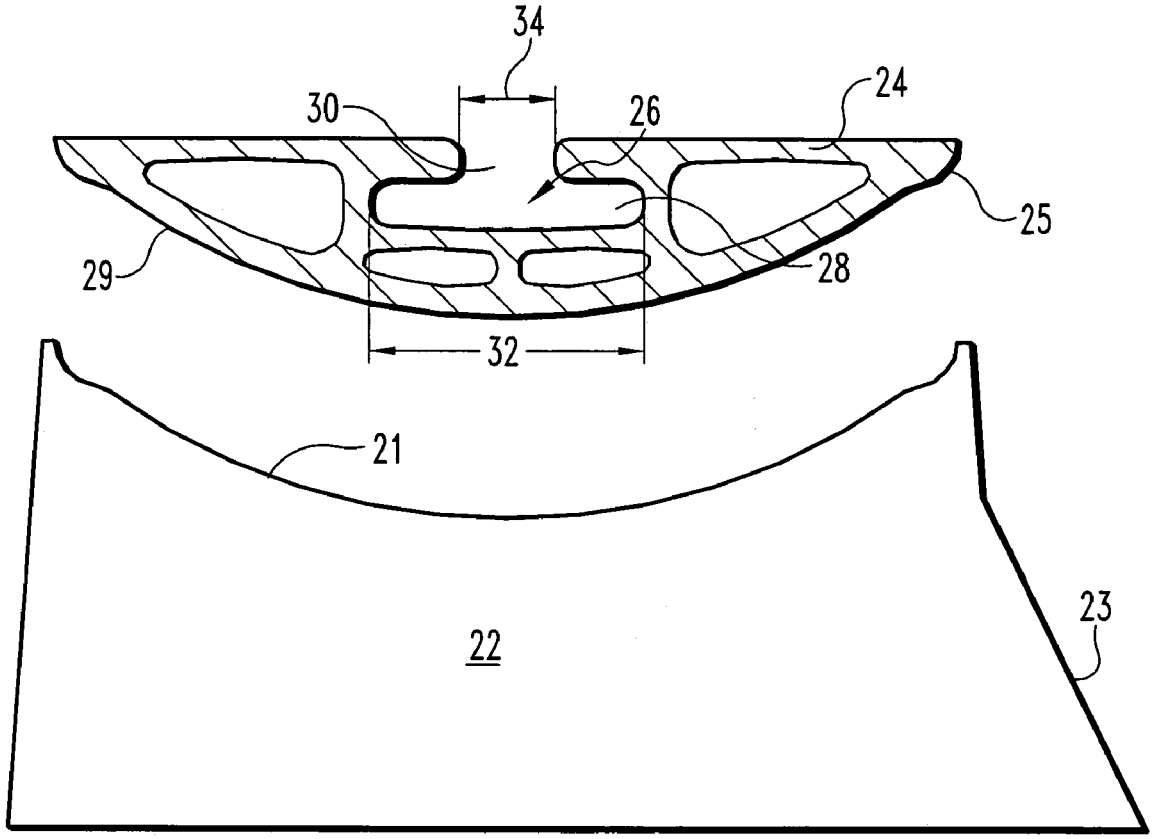
FIG. 6 is an exploded end view of a guard assembly according to one embodiment of the present invention.

Referring to FIG. 6, in one embodiment of the present invention the bottom surface 29 of rigid member 24 has a convex shape which fits in a complementary concaved-shaped surface 21 of wear pad 22. These shapes assist in maintaining a bond between rigid member 24 and wear pad 22 in at least two ways: (1) as compared to bonding surfaces that are horizontal and parallel, these curved surfaces have increased surface area for bonding; and (2) impact loads to the front of the wear pad are imparted from surface 21 to surface 29 in a combination of compression and shear, as opposed to the substantially pure shear of flat, horizontal bonding surfaces.

Likewise, referring to FIG. 10, impacts to wear pad 122 will be imparted from surface 121 onto surface 129 in a combination of compression and shear. Further, the cross sectional shape of surfaces 121 and 129 allow for increased surface area for bonding therebetween.

In one embodiment of the invention, as illustrated in FIG. 3, the elongate attachment portion 24 and wear pad 22 are manufactured separately and bonded together with a bonding agent. Before bonding the elongate attachment portion 24 and wear pad 22, the surface of the elongate attachment portion 24 can optionally be treated or conditioned to improve wear pad 22 adhesion to the surface. One preferred manner of attaching the wear pad to the elongate attachment portion includes degreasing and shot blasting the attachment portion, followed by application of a coat of rubber adhesive primer, followed by a top-coat of rubber adhesive. The wear pad can then be placed and held in position until bonding occurs between the wear pad and the attachment portion.

Preferred bonding agents are polymer based adhesives and can be obtained commercially from various companies, such as Lord Company (Cary, N.C.) and Rohm and Haas (Philadelphia, Pa.). While adhesive-based bonding agents are preferred, it is understood that any suitable bonding agent, or any mixture thereof, is included in the scope of this invention. Alternatively, the elongate attachment portion 24 can be affixed to the wear pad with other attachment means. One possible embodiment includes attaching the wear pad 22, or wear pad segments, to the elongate attachment portion 24 with at least one attachment means, such as a screw and nut combination. Attachment of wear pads to a common metal plate by screw and nut is disclosed in U.S. Pat. No. 5,611,157. This attachment method and others disclosed in U.S. Pat. No. 5,611,157 are hereby incorporated herein by reference. The wear pad can also be constructed from a plurality of modules that are placed in juxtaposition lengthwise and then bonded to the elongate attachment portion 24, or modules of guards can be assembled end-to-end on a bucket bottom as shown in FIG. 8.

The guard device 20 preferably runs the entire length of the bucket's bottom 12, as shown in FIG. 1; however, the guard device can be manufactured in lengths greater than the typical length of the edge of a bucket, and then cut to fit a particular bucket, being longer, shorter, or the same width of the bucket. Also, as suggested above, and as shown in FIG. 2, guards can be manufactured in modular lengths to be placed in series along the bottom 12 of the bucket 10. In certain preferred embodiments, the guard device 20 has a length of about 36 inches, about 40 inches or about 48 inches.

Figure 7:
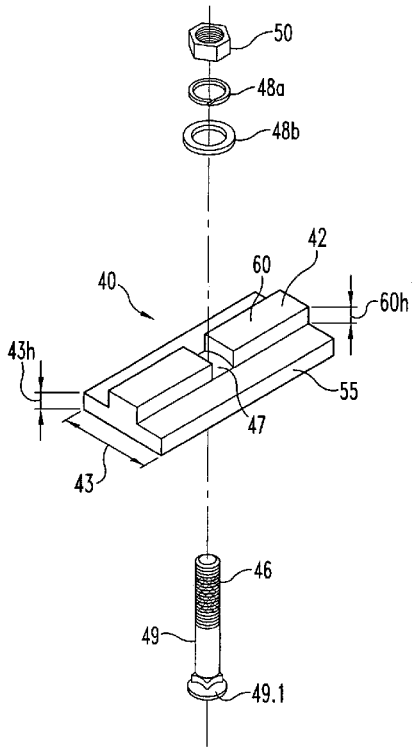
FIG. 7 is an exploded view of a fastener plate and a separate fastener according to one embodiment of the present invention.
Figure 8:
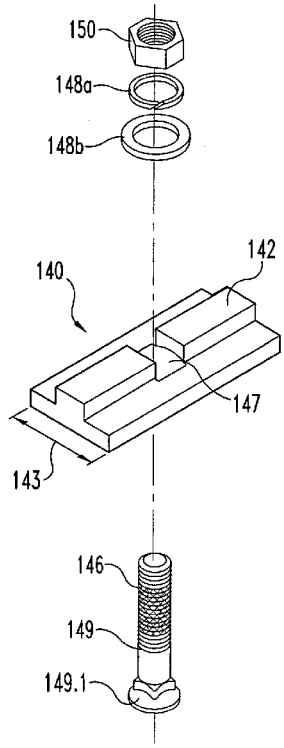
FIG. 8 is an exploded view of a fastener plate and a separate fastener according to one embodiment of the present invention.
Figure 9:
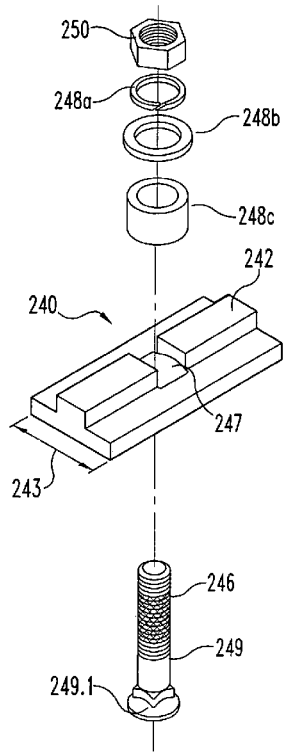
FIG. 9 is an exploded view of a fastener plate and a separate fastener according to one embodiment of the present invention.

FIGS. 7-9 depict fastener assemblies employed according to various aspects of the present invention. The use anywhere herein of an N prefix in front of an element number (NXX), denotes an element that is the same as the non-prefixed element (XX), except for the changes shown or described. FIGS. 7-9 depict fastener assemblies 40, 140, and 240, respectively, according to various embodiments of the present invention. Referring to FIG. 7, there is shown a fastener assembly 40 comprising a plate 42, separable fastener 49 and a nut 50. Sliding plate 42 has the cross-sectional shape of an upside-down "T", with a wide base 43 and an upward projecting top portion 60. Base (or head) 43 has a width that is adapted and configured to slide within longitudinal cavity 28. Top portion 60 has a width which is adapted and configured to be slidingly received between the walls of longitudinal slot 30. Base 43 has a height 43*h* that is adapted and configured to be received within the vertical height of longitudinal cavity 28. Top portion 60 is at a height 60*h* above base portion 43 such that the opposing sides of top portion 60 are received between the walls of longitudinal slot 28, and also that the top surface of top portion 60 does not extend above the top surface of rigid member 224.

Plate 42 includes within it an aperture 47 which is adapted and configured to receive within it the head 49.1 of fastener 49. In one embodiment, fastener 49 is a plough bolt, having four squared-off sides to resist rotation of fastener 49 within aperture 47. A threaded portion 46 of fastener 49 extends through sliding plate 42, and through an aperture within component 10, such that a nut 50 and locking flat washers 48*a* and 48*b*, respectively, can be attached thereto. FIGS. 7, 8, and 9, depict fastener assemblies 40, 140, and 240, respectively, of increasing fastener diameter. Fastener assembly 240 also includes a cylindrical member 248*c* which maintains the shank of fastener 249 centered within aperture 247. In some embodiments, the threaded shank of fastener 49 is coated with a dry thread locking coat such as those sold by 3M Company.

Figure 4:
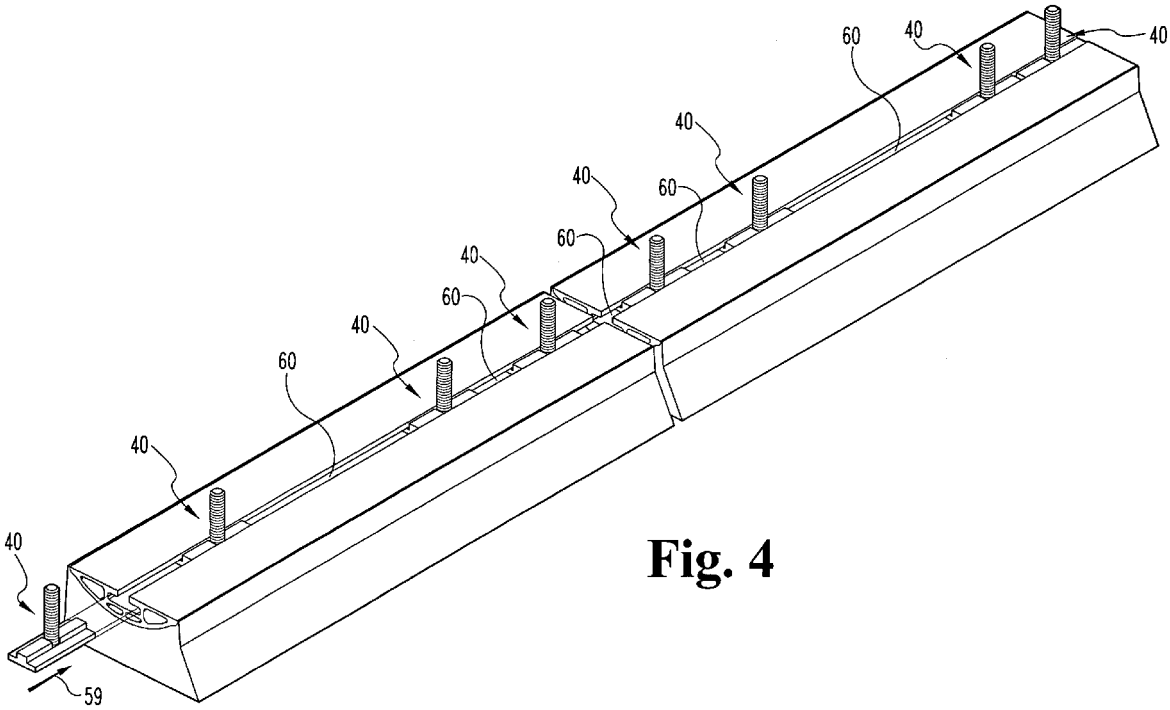
FIG. 4 is a perspective view of two modules according to one embodiment of the present invention, including fasteners spaced differently from FIG. 6, and with interval spacers between fasteners.
Figure 5:
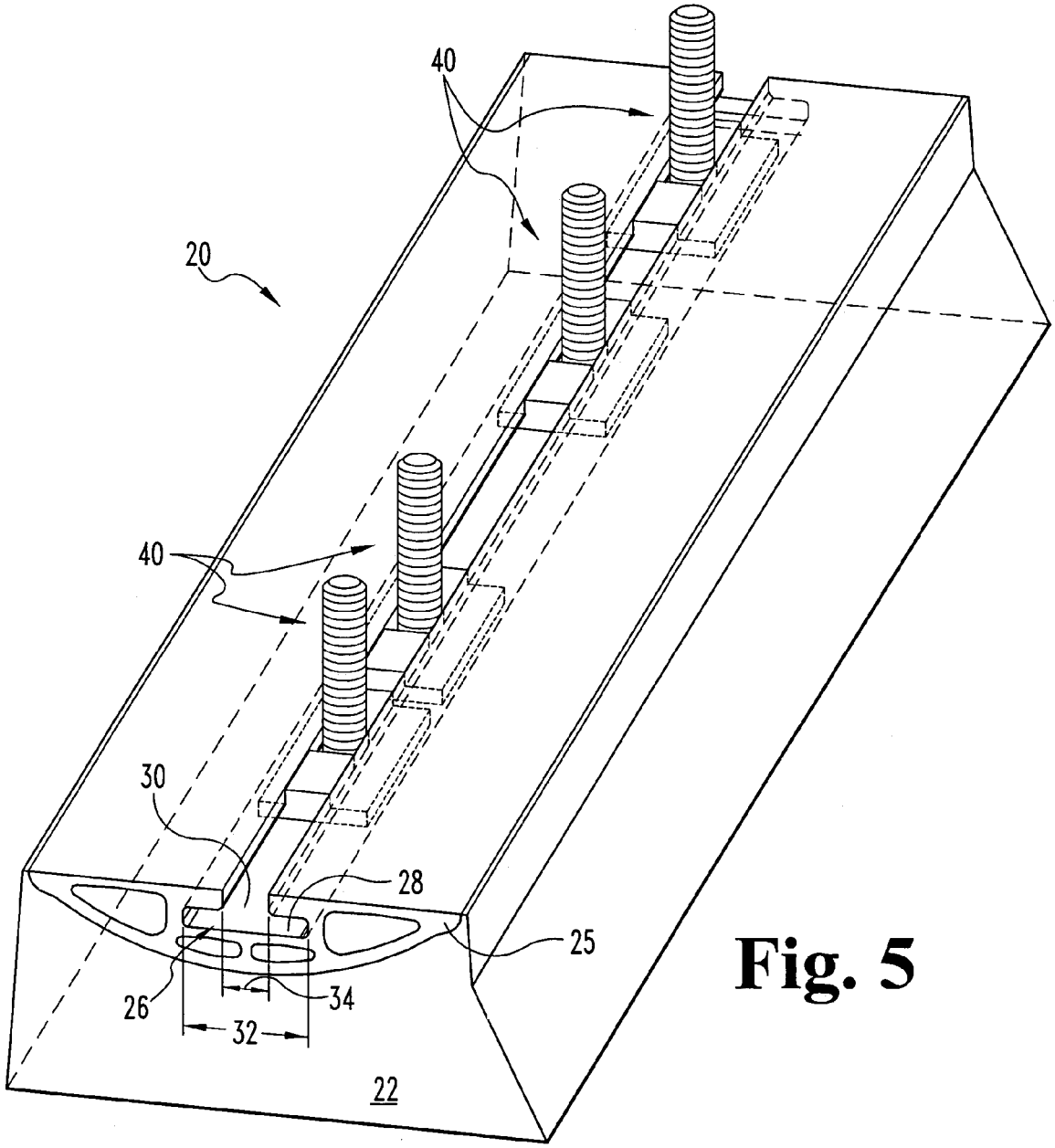
FIG. 5 is a perspective view of a portion of the guard assembly of FIG. 1, and including fasteners.

Referring to FIGS. 4 and 5, a guard 20 is depicted containing four fasteners 40 in the longitudinal track 26. While four fastener assemblies 40 are shown in FIG. 6, it is contemplated that at least one fastener assembly 40, and up to as many as will fit into the track 26 and find available receiver holes in the bucket, will be used. The cooperation of the track 26 and fastener head 42 allows each fastener member to freely slide longitudinally along and within track 26.

As shown in FIGS. 2 and 3, the guard 20 is secured to a bucket bottom 12 by placing the main body 46 of the fastener assembly 40 through the aperture in the bucket bottom 12 and securing it in place by use of a nut 50 and optionally washers 48. While a split pin might be used as mentioned above (not shown), embodiments that utilize threads on the main body 46 and a nut 50, with washers 48, both plain and lock, are preferred as such a fastening system is typically more robust.

As shown in FIGS. 2 and 3, a typical bucket 10 used to clean floor surfaces has bolt or stud receiver apertures for attaching a guard 20 to the surface engaging portion of the component 12. Due to various bucket manufacture specifications, the number and spacing of apertures in one bucket is often different from those in other buckets. Therefore, the versatility of positioning a plurality of fastener members 40 in a plurality of locations along the track 26, according to the present invention, facilitates the coupling of the guard 20 of this invention to buckets of various manufacturers in various widths and which may have been provided with various bolt spacings for conventional original equipment wear pads. To further facilitate aligning the fastener members 40 with the apertures in the surface engaging portion of the bucket 12 to be serviced, spacers of suitable lengths, such as spacers 60 in FIG. 4, can be placed in the track 26 between fastener members 40 in order to hold the spatial arrangements of the fasteners 40 during mounting of the guard to the bucket. The bucket apertures are typically cylindrical, but they can also be orthogonal or other geometrical shapes, or irregular.

Figure 12:
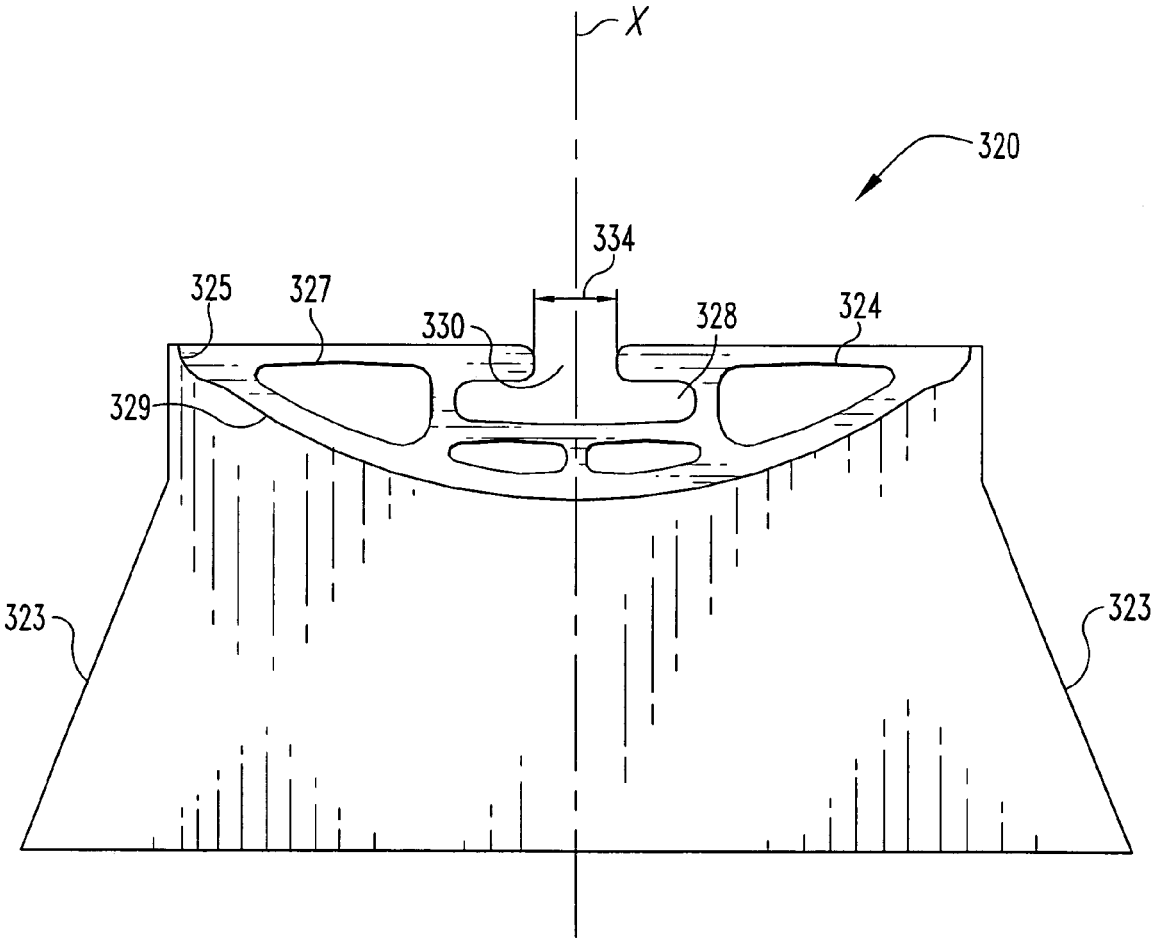
FIG. 12 is an end view of a guard assembly according to another embodiment of the present invention.

Referring to FIG. 12, there is shown a wear guard 320 according to another embodiment of the present invention. Wear guard 320 is symmetric about a vertical axis X. Both the front leading surface 323 and the rear trailing surface 323 are identical in shape, and both are centered about a central vertical axis X. Further, rigid member 324 is symmetrical about vertical axis X (in the three dimensional wear guard 320, the vertical center X is more correctly considered a plane). This fore and aft symmetry makes it possible (in some embodiments) to attach wear guard 320 to a vehicle in a first orientation, and after the leading edge of the wear guard has worn, to reverse the orientation of the wear guard on the vehicle so as to place the rear trailing edge as a new, unworn leading edge.

Various embodiments of the present invention provide novel devices, methods, and systems that find advantageous use in protecting components of material handling equipment and floor surfaces contacted thereby from damage caused during material handling operations. It is also contemplated that the wear guard will prove advantageous in numerous other applications. For example, one or more inventive wear guards can be installed on a conveyor system to protect the conveyor belt and/or other conveyor components from wear caused by friction.

Upon review of the various features and facets of the various embodiments of the invention described herein, it is appreciated that one form of the present invention is a guard to protect a vehicle component and surfaces contacted by the component. In one embodiment, the guard comprises an elongate attachment portion having a first surface and an opposing second surface, the first surface configured to be releasably secured to the component; and a wear pad mounted on the second surface. The attachment portion defines a longitudinal track to slidably receive a plurality of fastener members. The track has a longitudinal cavity and defines a longitudinal slot in the first surface. The cavity has a first cross-sectional width to slidably receive a head portion of a fastener member, and the slot has a second cross-sectional width less than the first cross-sectional width to slidably receive a central main body of the fastener member.

In another embodiment, the guard also includes at least one fastener member having a central main body and a head portion, the main body defining a fastener axis and having a dimension in at least one direction transverse to the axis that is less than the second cross-sectional width. The head portion is received in the cavity and slidable longitudinally in the cavity. The head portion has dimensions perpendicular to the fastener axis that are greater than the second cross-sectional width and less than the first cross-sectional width. In yet another embodiment, the fastener member is configured to resist rotation about the fastener axis when the fastener member is received in the track. In yet another embodiment, the head portion of the fastener member has at least one dimension perpendicular to the fastener axis that is greater than the width of the longitudinal cavity for guidance of the head portion while sliding in the cavity. In still another embodiment, the cavity is configured to engage a side surface of the head portion of the fastener member in a manner that inhibits rotation of the fastener member about a longitudinal axis of the body relative to the head portion.

The attachment portion of the wear guard preferably comprises a rigid material. In one embodiment, the attachment portion is an extrusion. A preferred material for use in making the attachment portion is aluminum or an aluminum alloy. The wear pad preferably comprises an elastomeric material. In one embodiment, the wear pad comprises rubber. The wear pad is preferably attached to the elongate member by bonding, preferably adhesive bonding.

In another aspect of the invention, a guard to protect a vehicle component and surfaces contacted by the component includes (1) an elongate attachment portion having a first surface and an opposing second surface, the first surface configured to be releasably secured to the component; and (2) a wear pad mounted on the second surface. The attachment portion defines a longitudinal track to slidably retain at least one fastener member along a pathway defined by the track. In a preferred embodiment, the track has a longitudinal cavity and defines a longitudinal slot in the first surface. In one preferred embodiment, the cavity has a first cross-sectional width to slidably receive ahead portion of a fastener member and the slot has a second cross-sectional width less than the first cross-sectional width to slidably receive a central main body of a fastener member.

In another aspect of the invention, there is provided a system for picking up or moving material from a surface. The system includes: (1) a vehicle having a component used to pick up or push material from a surface, the component having a bottom portion that is operable close to the surface and has a plurality of apertures to receive fasteners; and (2) a guard removably secured to the bottom portion of the component, the guard including an elongate attachment portion having a first surface and an opposing second surface, the first surface configured to be releasably secured to the component, and the guard having a wear pad mounted on the second surface. The attachment portion defines a longitudinal track to slidably retain a plurality of fastener members along a pathway defined by the track. A plurality of fastener members are retained in the track, each of the fastener members oriented along the track in a manner whereby a portion of the fastener member is positioned to extend through one of the apertures. In one preferred embodiment, the longitudinal track has an internal longitudinal cavity having an opening defining a longitudinal slot in the first surface, the cavity having a first cross-sectional width to slidably receive a head portion of the fastener members and the slot having a second cross-sectional width less than the first cross-sectional width to slidably receive a central main body of the fastener members. In another preferred embodiment, the fastener members have a central, generally cylindrical main body and a head portion, the main body defining a fastener axis and having a diameter less than the second cross-sectional width, and the head portion having dimensions perpendicular to the fastener axis that are greater than the second cross-sectional width and less than the first cross-sectional width.

In another embodiment, the system includes: (1) a vehicle having a component used to pick up or push material from a surface, the component having a surface-engaging portion that contacts the surface and defining a plurality of apertures aligned along a longitudinal axis in the surface-engaging portion; (2) a guard removably secured to the surface-engaging portion of the component, the guard including an elongate attachment portion having a first surface and an opposing second surface, the first surface configured to be releasably secured to the component; and a wear pad mounted on the second surface; and (3) means on the guard for receiving and positioning fasteners for affixing the attachment portion to the surface-engaging portion.

In alternative aspects of the invention, the vehicle is, for example, a tractor, a truck, a bulldozer, a grader, a fork truck, a car or a conveyor system. The component can be, for example, a bucket, a scoop, a blade, a fork or a plow.

In another aspect of the invention, there is provided a method for protecting against damage of the type that results from contact between a floor surface and a surface-engaging component of a vehicle used to pick up or push material from the surface. In one manner of practicing the invention, the method includes: (1) providing a guard that includes (a) an elongate attachment portion having a first side and an opposing second side, the first side having an elongate track formed therein and configured to be releasably secured to the component, and (b) a wear pad having a first side for engaging the floor and an opposing second side affixed to the second side of the attachment portion; (2) sliding a plurality of fastener members in the track to position the fastener members at locations corresponding to at least some apertures of a surface engaging component of a vehicle; and (3) mounting the attachment portion to the component by inserting a portion of each fastener member into a corresponding one of the apertures and securing the fastener members to the component. It is understood that this method will commonly be employed using a vehicle component that features apertures having predetermined spacings. As such, another manner of practicing the invention includes inserting interval spacers in the track between the fastener members to space the fastener members such that the positions of the fastener members correspond to at least some of the apertures.

In another aspect, the invention provides a method for making a wear guard. The method includes: (1) providing an elongate attachment portion having a first side and an opposing second side, the first side having an elongate track formed therein and configured to be releasably secured to a component; (2) providing a wear pad having a first side for engaging the floor and an opposing second side configured for attachment to the second side of the attachment portion; and (3) attaching the second side of the wear pad to the second side of the attachment portion.

In one manner of practicing the invention, the method also includes inserting a plurality of fastening members into the track. In one embodiment, each of the fastening members has a central main body and a head portion, which can have a wide variety of features as described herein. In one embodiment, the cavity is configured to engage a side surface of the head portion of the fastener member in a manner that inhibits rotation of the fastener member about a longitudinal axis of the body relative to the head portion. The attachment portion and the wear pad can also have a wide variety of different features and configurations as described herein.

Figure 13:
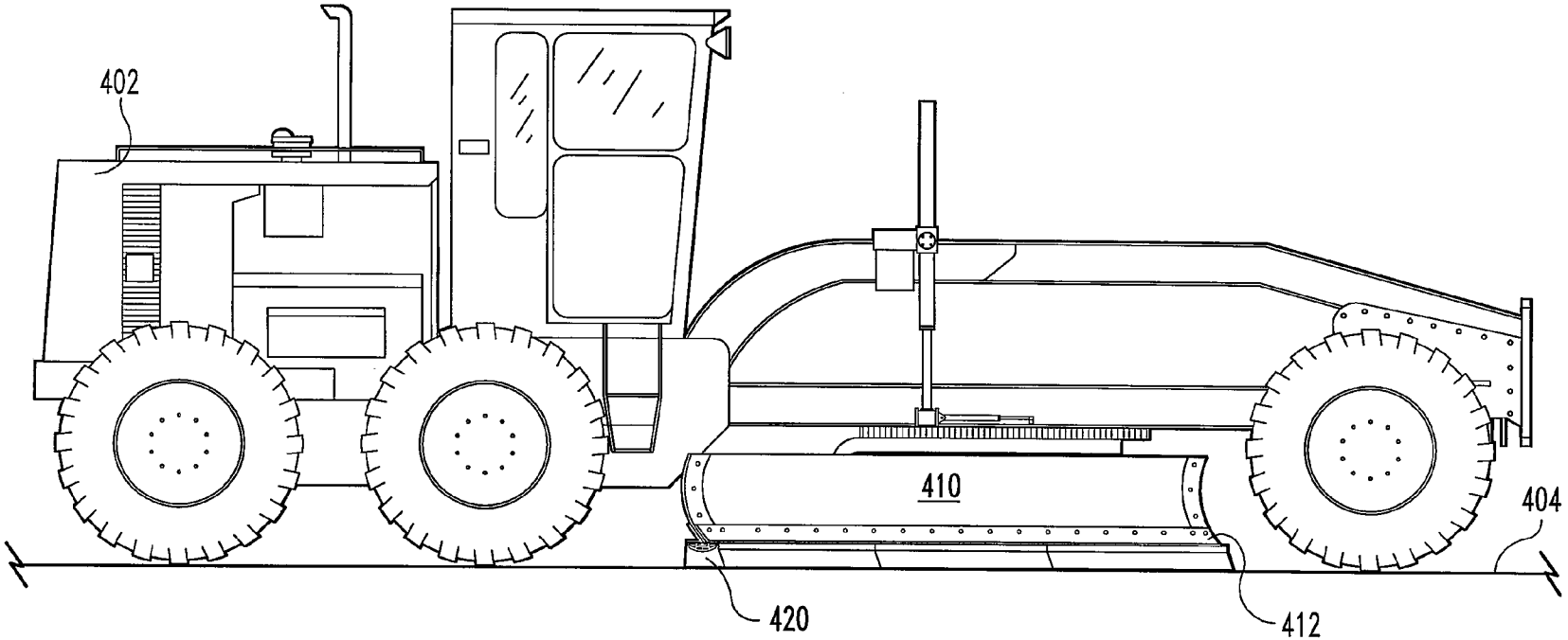
FIG. 13 is a side view of a grader with a guard assembly on the blade according to another embodiment of the present invention.

FIG. 13 depicts a guard 420 according to another embodiment of the invention for protecting the bottom surface of a component such as a blade 410 and the surface 404 otherwise contacted by the blade 410. The guard 420 is mounted to the bottom 412 of the blade 410, which is mounted on a grader 402. As seen in FIG. 13, blade 410 has mounted to the bottom of it three separate guards 420.

Figure 14:
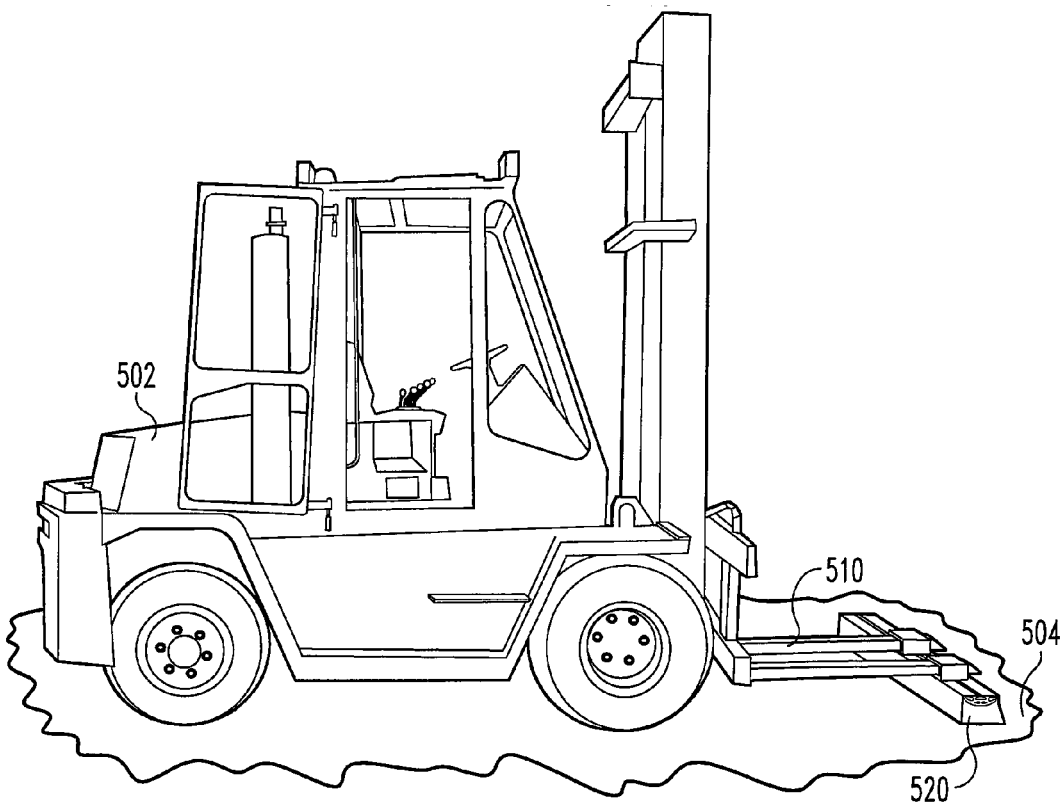
FIG. 14 is a perspective view of a fork truck with a guard assembly on the forks according to still another embodiment of the present invention.

FIG. 14 depicts a guard 520 according to still another embodiment of the invention for protecting the bottom surface of a component such as a fork 510 and the surface 504 otherwise contacted by the fork 510. The guard 520 is mounted on the bottom of the fork 510, which is mounted on a fork truck 502. As seen in FIG. 14, fork 510 has mounted to the bottom surface of it a single guard 520. However, the present invention also contemplates those embodiments in which multiple guards extend across the bottom of the component being protected.

Figure 15:
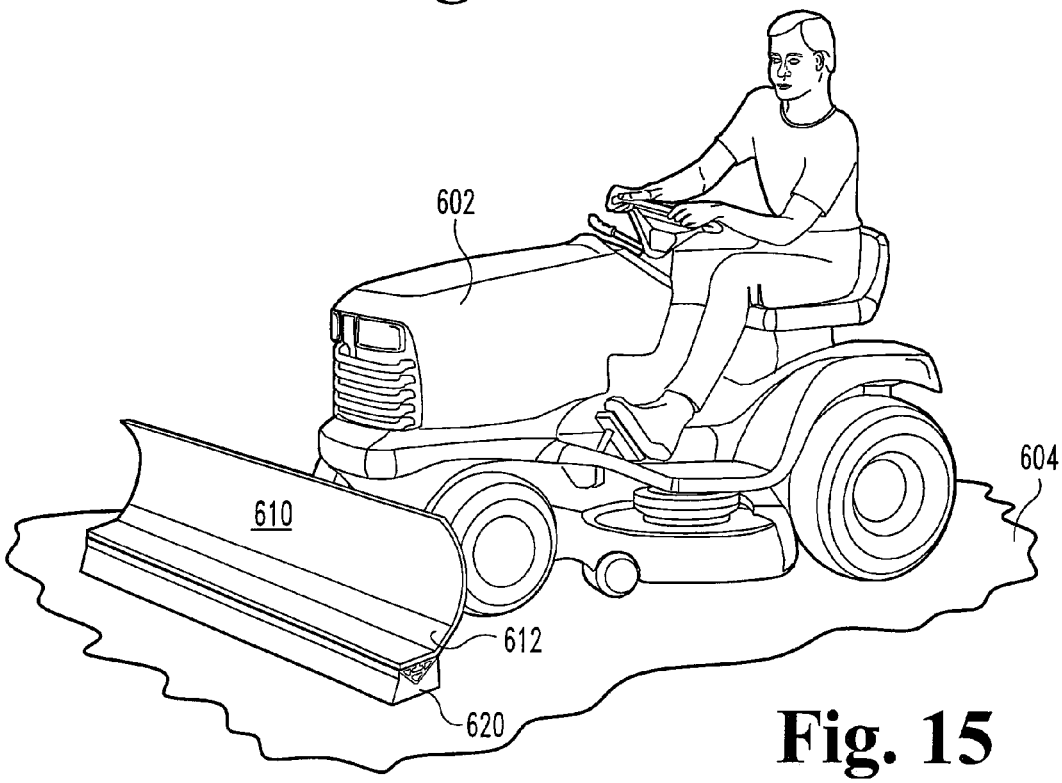
FIG. 15 is a perspective view of a tractor with a guard assembly on the plow according to a further embodiment of the present invention.

FIG. 15 depicts a guard 620 according to a further embodiment of the invention for protecting the bottom surface of a component such as a plow 610 and the surface 604 otherwise contacted by the plow 610. The guard 620 is mounted to the bottom 612 of the plow 610 which is mounted on a tractor 602. As seen in FIG. 15, plow 610 has mounted to the bottom surface of it a single guard 620. However, the present invention also contemplates those embodiments in which a multiple guards extend across the bottom of the component being protected.

Figure 16:
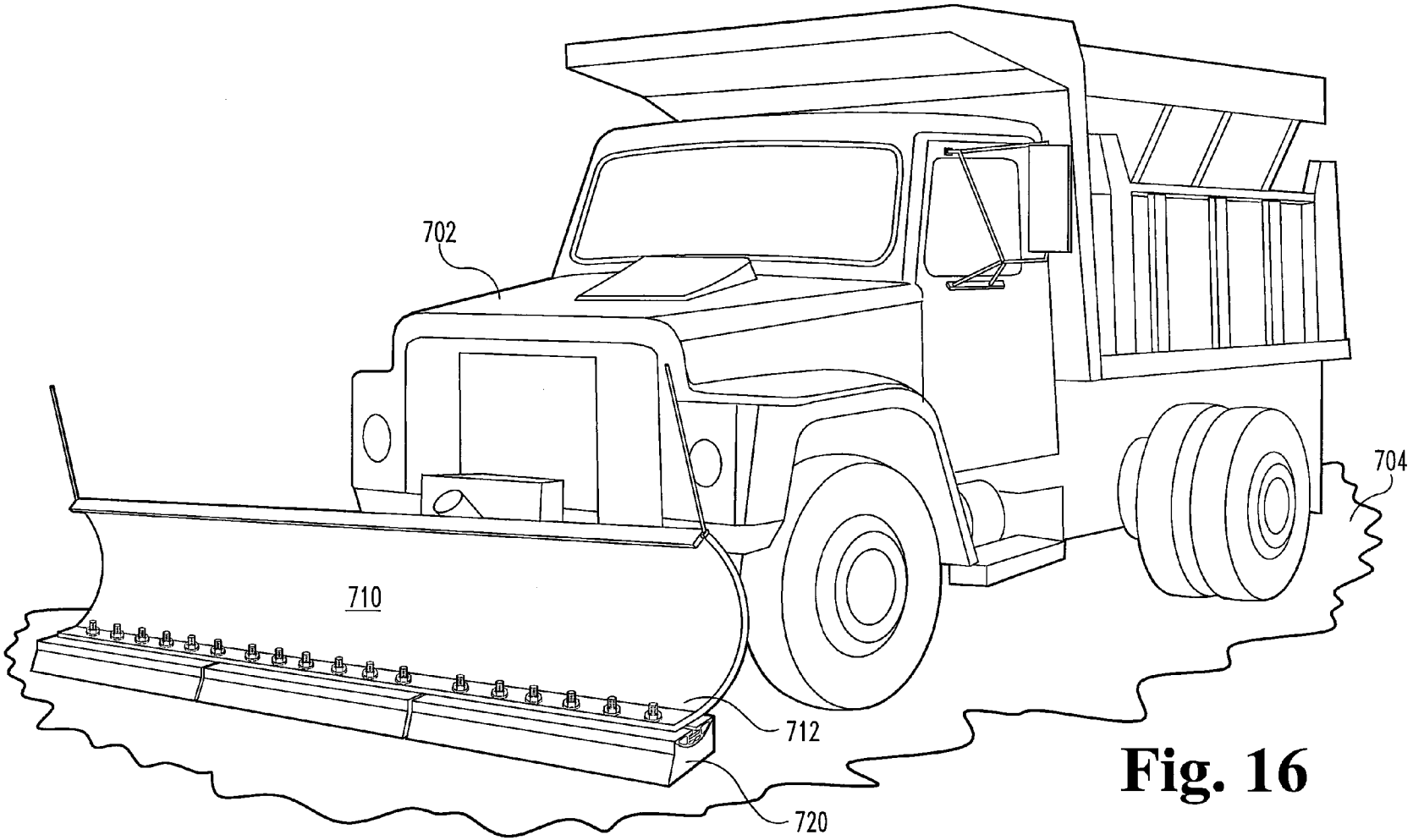
FIG. 16 is a perspective view of a truck with a guard assembly on the plow according to yet another embodiment of the present invention.

FIG. 16 depicts a guard 720 according to yet another embodiment of the invention for protecting the bottom surface of a component such as a plow 710 and the surface 704 otherwise contacted by the plow 710. The guard 720 is mounted to the bottom 712 of the plow 710, which is mounted on a truck 702. As seen in FIG.16, plow 710 has mounted to the bottom surface of it three separate guards 720. However, the present invention also contemplates those embodiments in which a single guard extends across the bottom surface of the component being protected.

Figure 17:
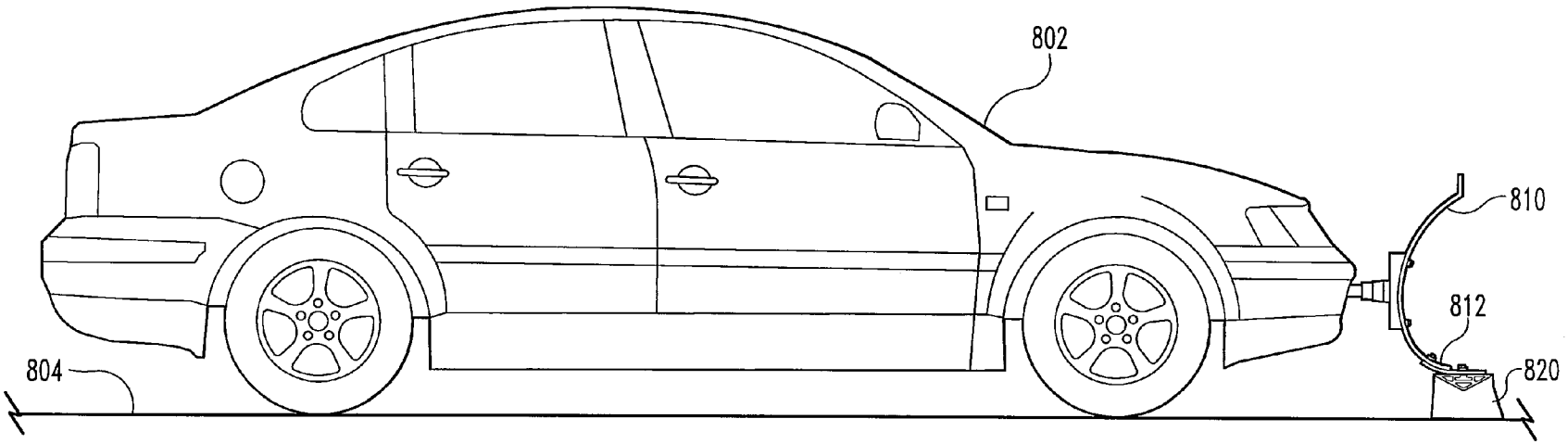
FIG. 17 is a side view of a car with a guard assembly on the plow according to still a further embodiment of the present invention.

FIG. 17 depicts a guard 820 according to still a further embodiment of the invention for protecting the bottom surface of a component such as a plow 810 and the surface 804 otherwise contacted by the plow 810. The guard 820 is mounted to the bottom 812 of the plow 810, which is mounted on a car 802.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. In addition, all patents and non-patent publications cited herein are hereby incorporated by reference in their entirety as if individually incorporated and fully set forth herein.

What is claimed is:

1. An apparatus, comprising:

a wear guard for protecting a bottom surface of a vehicle, including a resilient member having a first length, and a top surface which is at least partially concave; and a rigid member having a second length about the same as the first length, a width substantially less than the second length, said width defined by two spaced-apart edges, said rigid member having a central portion between said two edges, and a height less than its width, said height defined by a top surface and a bottom surface, wherein the shape of said rigid member bottom surface is convex adjacent the central portion, convex adjacent at least one of said two spaced-apart edges, concave between the central portion and the at least one of said two spaced-apart edges, and complementary to the shape of the top surface of said resilient member, wherein said rigid member top surface defines a slot across substantially the entire second length; and wherein the bottom surface of said rigid member is attached to the top surface of said resilient member.

2. The apparatus of claim 1 wherein said rigid member has opposing ends separated by the second length, said slot being open at one of said ends.

3. The apparatus of claim 1 wherein said rigid member defines a lengthwise channel, the slot being open to the channel.

4. The apparatus of claim 1 wherein said resilient member comprises an elastomeric material that is bonded to said rigid member.

5. The apparatus of claim 1 wherein said rigid member is aluminum extrusion.

6. The apparatus of claim 1 wherein said resilient member is integrally molded as one piece from an elastomeric material.

7. A plurality of wear guards, comprising:

a plurality of wear guards as described in claim 1, at least one wear guard having a resilient member with a first length equal to approximately 36 inches, at least one wear guard having a resilient member with a first length equal to approximately 40 inches, and at least one wear guard having a resilient member with a first length equal to approximately 48 inches.

8. The apparatus of claim 1, further comprising:

a vehicle component attached to said rigid member.

9. The apparatus of claim 8, further comprising:

a vehicle attached to said vehicle component.

10. The apparatus of claim 1, wherein said rigid member includes a horizontal reinforcing portion adjacent said top surface and extending between said at least one edge and said slot; and an angled reinforcing portion adjacent said bottom surface and extending from said at least one edge toward the other of said two spaced-apart edges, said horizontal and angled reinforcing portions forming a cavity therebetween and extending along said rigid member second length.

11. An apparatus for protecting a bottom surface of a component of a vehicle, comprising:

an elastomeric member having a first length substantially greater than its width, said elastomeric member having a non-planar top surface; and a supporting member having a front, a rear, a top surface, a bottom surface, and a second length about the same as the first length, the bottom surface of said supporting member having a shape that is generally complementary to the shape of the top surface of said elastomeric member, the top surface of said supporting member defining a track oriented along the length of said supporting member, said track including a slot and a wider channel below the slot, the distance from the top surface of said supporting member to the bottom surface of said supporting member being nonconstant from front to rear;

wherein the bottom surface of said supporting member is attached to the top surface of said elastomeric member.

12. The apparatus of claim 11 wherein said supporting member is adapted and configured to have an area moment of inertia that increases in a direction from front to rear for the portion of the supporting member from the front to the forward edge of the track.

13. The apparatus of claim 12 wherein a vertical and longitudinal plane extends parallel to said slot and is centered within said slot, said elastomeric member being symmetric about the plane and said supporting member being symmetric about the plane.

14. The apparatus in accordance with claim 11 wherein the supporting member is fabricated from a single piece of aluminum.

15. The apparatus of claim 11 wherein the component is selected from the group including a bucket, a scoop, a blade, a fork or a plow, and said apparatus is fastened to the bottom of said component.

16. The guard in accordance with claim 11 wherein the vehicle is a conveyor.

17. An apparatus to protect a vehicle component, comprising:

a resilient member having a first length substantially greater than its width, said resilient member having a non-planar top surface;

a supporting member having a front, a rear, a top surface, a bottom surface, and a second length about the same as the first length, the top surface defining a slot oriented parallel to the second length of said supporting member, said slot having a width, said supporting member defining a channel below said slot, said channel having a depth, said channel having a width that is greater than the width of said slot; and a plurality of fastener plates, each fastener plate having a bottom portion slidably received by said channel, the bottom portion having a width greater than the width of the slot, each said fastener plate having a top portion slidably received within the opening of said slot, each said fastener plate being adapted and configured such that at least part of the top portion has a height which is greater than the depth of the channel.

18. The apparatus of claim 17 wherein each fastener plate defines a hole for receiving a fastener.

19. The apparatus of claim 17 wherein each fastener plate includes a threaded portion adapted and configured to extend out of the opening of said slot.

20. The apparatus of claim 17 wherein each said fastener plate includes a hole adapted and configured to receive a separable fastener therethrough.

21. The apparatus of claim 20 wherein each hole is adapted and configured to resist rotation of a fastener extending therethrough.

22. An apparatus to protect a vehicle on a roadway from objects on the roadway, comprising:

a resilient member having a first length substantially greater than its width, said resilient member having a forward face and a rearward face, each said face being adapted and configured for upward deflection of objects on the roadway, said resilient member having a bottom surface adapted and configured for sliding contact with the roadway, said resilient member having a top and a plane extending vertically through said member; and a supporting member bonded to the top of said resilient member with a bonding agent, said supporting member defining a slot centered about the plane and parallel to the plane, said supporting member defining a channel below said slot, said channel having a width that is greater than the width of said slot, said channel being centered about the plane and parallel to the plane.

23. The apparatus of claim 22 which further comprises a plurality of fastener plates, each fastener plate having a bottom portion adapted and configured to be slidably received by said channel, the bottom portion having a width greater than the width of the slot, each said fastener plate having a top portion slidably received within the opening of said slot.

24. The apparatus of claim 22 wherein an angle between the forward face and the roadway is less than about 135 degrees and more than 90 degrees.

25. The apparatus of claim 22 wherein said supporting member is extruded and has a convex bottom surface for bonding to a concave top surface of said resilient member.

26. The apparatus of claim 22 wherein the vehicle is a tractor, truck, bulldozer, grader, fork truck, or car.

27. The apparatus of claim 22 wherein said supporting member includes an upper surface and a lower surface, said lower surface being bonded to the top of said resilient member and said upper surface defining said slot.

28. An apparatus for protecting a bottom surface of a vehicle, comprising:

a resilient member having a first length substantially greater than its width, said resilient member having a top surface which is at least partially concave;

a rigid member having a second length about the same as the first length, said rigid member having a bottom surface which is at least partially convex in a shape that is complementary to the concave shape of the top surface of said resilient member, said rigid member having a top surface which defines a slot across substantially the entire second length;

wherein the bottom surface of said rigid member is attached to the top surface of said resilient member; and wherein said rigid member is aluminum extrusion.

29. An apparatus for protecting a bottom surface of a component of a vehicle, comprising:

an elastomeric member having a first length substantially greater than its width, said elastomeric member having a non-planar top surface;

a supporting member having a front, a rear, a top surface, a bottom surface, and a second length about the same as the first length, the bottom surface having a shape that is generally complementary to the shape of the top surface of said elastomeric member, the top surface defining a slot oriented along the length of said supporting member, the distance from the top surface of said supporting member to the bottom surface of said supporting member being nonconstant from front to rear;

wherein the bottom surface of said supporting member is attached to the top surface of said elastomeric member; and wherein the component is selected from the group including a bucket, a scoop, a blade, a fork or a plow, and said apparatus is fastened to the bottom of said component.

* * * * *